United States Patent [19]

Ohga et al.

[11] Patent Number: 4,822,768

[45] Date of Patent: Apr. 18, 1989

[54] PRESSURE SENSITIVE RECORDING SHEET

[75] Inventors: Kunihiko Ohga; Keiso Saeki, both of Shizuoka, Japan

[73] Assignee: Fuji Photo Film Co., Ltd., Kanagawa, Japan

[21] Appl. No.: 112,172

[22] Filed: Oct. 26, 1987

[30] Foreign Application Priority Data

Oct. 24, 1986 [JP] Japan ..... 61-252851

[51] Int. Cl.[4] ..... B41M 5/16

[52] U.S. Cl. ..... 503/214; 427/150; 427/151; 428/342; 428/914; 503/207; 503/215; 503/225

[58] Field of Search ..... 427/150–152; 428/914, 341, 342; 503/207, 200, 226, 214, 215, 225

[56] References Cited

U.S. PATENT DOCUMENTS

| | | | |
|---|---|---|---|
| 3,894,168 | 7/1975 | Brockett et al. | 503/207 |
| 4,154,462 | 5/1979 | Golden et al. | 503/207 |
| 4,162,165 | 7/1979 | Schwab | 503/207 |
| 4,327,939 | 5/1982 | Ehrhardt et al. | 503/224 |
| 4,404,251 | 9/1983 | Jabs et al. | 503/207 |
| 4,448,446 | 5/1984 | Flores | 503/224 |
| 4,486,762 | 12/1984 | Okamoto et al. | 503/207 |

FOREIGN PATENT DOCUMENTS

| | | | |
|---|---|---|---|
| 1317543 | 5/1973 | United Kingdom | 503/215 |
| 2022646 | 12/1979 | United Kingdom | 503/215 |
| 1581758 | 12/1980 | United Kingdom | 503/215 |

OTHER PUBLICATIONS

Shibazaki, "The Effect of Fine Calcium Carbonate Particles Upon the Coated Paper", Learned Society of Polymer in Japan, 6/25/82.

*Primary Examiner*—Bruce H. Hess
*Attorney, Agent, or Firm*—Sughrue, Mion, Zinn, Macpeak & Seas

[57] ABSTRACT

A pressure-sensitive recording sheet which forms a colored image by the reaction of an electron donating color former with an electron accepting developer, comprising a support having provided thereon a microencapsulated electron donating color former and an electron accepting developer is disclosed, wherein one or more layers containing the microencapsulated electron donating color former contains at least one pigment having a pH of 8.5 or more.

9 Claims, No Drawings

PRESSURE SENSITIVE RECORDING SHEET

FIELD OF THE INVENTION

The present invention relates to a pressure-sensitive recording sheet, and more particularly it relates to a pressure-sensitive recording sheet providing colored images by the reaction of an electron donating color former with an electron accepting developer.

BACKGROUND OF THE INVENTION

Pressure-sensitive recording sheets may be a combination of sheets which include an upper paper comprising a paper support having provided thereon a microcapsule layer containing microcapsules prepared by encapsulating oil drops of a substantially colorless electron donating color formers dissolved in an appropriate solvent, a lower paper comprising a paper support having provided thereon a developer layer containing an electron accepting developer and, in some cases, an intermediate paper comprising a paper support having provided on one side surface a microcapsule layer and on the other side surface a developer layer; a sheet comprising a paper support having provided on one surface both the above described capsule and a developer; and a sheet comprising a paper support wherein one of a capsule or a developer is contained therein and the other is coated thereon.

The above described sheets are disclosed, for example, in U.S. Pat. Nos. 2,505,470, 2,505,489, 2,550,471, 2,730,457 and 3,418,250.

However, the above described sheets do not always achieve satisfactory results. For example, when a microcapsule layer containing a color former is piled on an intermediate paper or a lower paper facing the developer layer thereof after printing is done on an upper paper or an intermediate paper, fog formation takes place on the developer layer with the passage of time. When an upper paper is used alone, as when the capsules are ruptured, color forms on the capsule layer and the capsule layer is thus stained.

The color stain of the capsule layer is remarkably heavy, particularly when styrene-butadiene latex is used as a binder for the capsule layer.

SUMMARY OF THE INVENTION

A first object of the present invention is to provide a pressure-sensitive recording sheet having a developer layer which is free from fog formation due to printing.

A second object of the present invention is to provide a pressure-sensitive recording sheet with a capsule layer which is free from the color staining effect.

The objects of the present invention can be attained by a pressure-sensitive recording sheet which forms a colored image by the reaction of an electron donating color former with an electron accepting developer, comprising a support provided thereon a microencapsulated election donating color former and an electron accepting developer, wherein one or more layers containing the microencapsulated electron donating color former contains at least one pigment having a pH of 8.5 or more. The pH referred to herein is the pH of a 10 wt % aqueous dispersion of pigments as measured by a pH meter.

DETAILED DESCRIPTION OF THE INVENTION

The basic pigments used in the present invention are not particularly limited. The pigments having a pH of 8.5 or more may be selected from pigments such as calcium oxide, calcium hydroxide, calcium carbonate, calcium metasilicate, magnesium calcium carbonate, magnesium hydroxide, magnesium carbonate, magnesium oxide, aluminum hydroxide, aluminum silicate or calcium coated silicic acid.

The coating amount of pigments is from 0.01 to 1.0 $g/m^2$, preferably from 0.05 to 0.5 $g/m^2$. These pigments may be added directly to a coating solution containing microcapsules or these pigments may be dispersed in water with dispersing aids such as sodium hexametaphosphate, polyvinyl alcohol or sodium dioctyl sulfosuccinate by means of a media dispersing machine such as a sand mill, a ball mill, an attritor or a Kedy mill and then may be added thereto.

The present invention is effective when styrenebutadiene latex, particularly carboxy modified styrenebutadiene latex, is included in the microcapsule layer.

The color formers used in a recording sheet of the present invention are not particularly limited. Specific examples thereof are triaryl methane type compounds, diphenyl methane type compounds, xanthene type compounds, thiazine type compounds, spiro type compounds and a mixture of two or more of these compounds. Specific examples of triarylmethane compounds include 3,3-bis-(p-dimethylaminophenyl)-6-dimethylaminophthalide (namely, Crystal Violet lactone), 3,3-bis-(dimethylaminophenyl)phthalide, 3-(p-dimethylaminophenyl)-3-(1,2-dimethylindol-3-yl)phthalide, 3-(p-dimethylaminophenyl)-3-(2-methyl-in-dol-3-yl)phthalide, 3-(p-dimethylaminophenyl)-3-(2-phenyl-indol-3-yl)phthalide, 3,3-bis-(1,2-dimethylindol-3-yl)-5-dimethylaminophthalide, 3,3-bis-(1,2-dimethylindol-3-yl)-6-dimethylaminophthalide, 3,3-bis-(9-ethylcarbazol-3-yl)-5-dimethylaminophthalide, 3,3-bis-(2-phenylindol-3-yl)-5-dimethylaminophthalide and 3-p-dimethylaminophenyl-3-(1-methylpyrrol-2-yl)-6-dimethylaminophthalide. Specific examples of diphenylmethane compounds include 4,4'-bis-dimethylaminobenzhydrin benzyl ether, N-halophenyl leuco Auramine and N-2,4,5-trichlorophenyl leuco Auramine. Specific examples of xanthene compounds include Rhodamine B anilino lactam, Rhodamine (p-nitroanilino)lactam, Rhodamine B (p-chloroanilino)lactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro-2-methylfluoran, 7-diethylamino-2,3-dimethylfluoran, 7-diethylamino-(3-acetylmethylamino)fluoran, 7-diethylamino-(3-methylamino)-fluoran, 3,7-diethylaminofluoran, 7-diethylamino-3-(dibenzylamino)fluoran, 7-diethylamino-3-(methylbenzylamino)fluoran, 7-diethylamino-3-(chloroethylmethylamino)fluoran and 7-diethylamino-3-(diethylamino)fluoran. Specific examples of thiazine compounds include benzoyl leuco Methylene Blue and p-nitrobenzyl leuco Methylene Blue. Specific examples of spiro compounds include 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methylnaphtho-(3-methoxybenzo)spiropyran and 3-propyl-spiro-dibenzopyran. These compounds may be used alone or as a mixture.

The coating amount of the color formers is preferably from 0.05 to 0.15 g/m$^2$.

These color formers are dissolved in a solvent for encapsulation and then coated on a support.

The solvents can be natural, synthetic or mixed solvents which may be used alone or in combination. Specific examples of solvents are cotton seed oil, kerosene, paraffin, naphthene oil, alkylated biphenyl, alkylated tarphenyl, chlorinated paraffin, alkylated naphthalene and diphenyl alkane.

Methods for preparing a microcapsule containing a color former include an interfacial polymerization method, an internal polymerization method, a phase separation method, an outer polymerization method and a coacervation method.

Upon preparing a solution of color former-containing microcapsule, an water soluble binder and a latex type binder are generally used, and a capsule protecting agent such as cellulose powders, starch particles or talc are added. These color former-containing microcapsules can be prepared as described, for example, in U.S. Pat. Nos. 2,800,457, 3,418,250, 2,800,458, 3,287,154 and 3,726,804.

Examples of developers which react with a color former used in a recording sheet of the present invention include clay substances such as acid clay, active clay, atapalgite, zeolite, bentonite or kaolin, metal salts of aromatic carboxylic acids and phenol resins.

These developers are coated on a support such as a paper together with a binder such as styrene butadiene latex.

The efficiencies of a microcapsule sheet used for pressure-sensitive recording of the present invention were tested using the following developer sheet. Unless indicated otherwise, all parts, percents and ratios are by weight.

PREPARATION OF THE DEVELOPER SHEET 2 parts of zinc oxide, 18 parts of calcium carbonate and 4 parts of zinc 3,5-di-α-methylbenzyl salicylate were added to 70 parts of water and then mixed and dispersed by an attritor for 30 minutes. Then, 2.5 parts by solid content of carboxy modified styrenebutadiene rubber (SBR) latex and 12 parts of a 10 wt % aqueous solution of PVA (degree of saponification: 99%, degree of polymerization: 1,000) were added to the dispersion and stirred to prepare a homogeneous coating solution. The coating solution was coated on a base paper having a basis weight of 50 g/m$^2$ using an air knife coating device, so that the coating amount according to solid content was 4 g/m$^2$ and was dried to obtain a developer sheet.

The present invention will be illustrated in more detail by the following Examples, but should not be limited thereto.

EXAMPLES 1 TO 3 AND COMPARATIVE EXAMPLE 1

Partial sodium salt of polyvinylbenzenesulfonate ("VERSA TL500", a trade name, manufactured by National Starch Co., Ltd., average molecular weight: 500,000) was used as a water-soluble high molecular weight substance. 5 g of VERSA TL500 was added to 95 g of hot water having a temperature of about 80° C. and dissolved while stirring and then cooled. The pH of the aqueous solution was from 2 to 3, and a 20 wt % aqueous solution of sodium hydroxide was added to adjust the pH of the solution to a pH of 6.0.

4 g of crystal violet lactone (CVL) as a color former was added to 100 g of KMC-113 (a trade name, manufactured by Kureha Chemical Industry Co., Ltd., alkylnaphthalene mainly comprised of diisopropylnaphthalene), heated and dissolved to obtain a hydrophobic solution to be encapsulated. The resulting hydrophobic solution was cooled to 20° C., and 0.3 g of 4,4'-diphenylmethane diisocyanate (MDI) ("Millionate MR100", a trade name, manufactured by Nippon Polyurethane Industries Co., Ltd.) was added thereto and dissolved, and was added to the above described aqueous solution of the watersoluble high molecular weight substance while vigorously stirring to emulsify to obtain O emulsion. When the oil drop size of the emulsion reached an average of 5.0 μ, stirring was stopped to obtain an emulsion.

On the other hand, 6 g of melamine, 11 g of a 37 wt % aqueous solution of formaldehyde and 83 g of water were heated to 60° C. while stirring and, in 30 minutes, a mixture of an aqueous solution of transparent melamine, formaldehyde and an initially condensed product of melamine-formaldehyde were obtained. The mixture had a pH of from 6 to 8. The mixture was added to the above described emulsion and mixed with stirring, adjusting its pH to 6.0 by adding a 10 wt % aqueous solution of phosphoric acid, heating to 65° C. with stirring. After about 1 hour, encapsulation was terminated.

The capsule solution was cooled to room temperature and its pH was adjusted to 9.0 by adding 20 wt % sodium hydroxide.

100 parts of a 15% aqueous solution of PVA (saponification degree: 88%, degree of polymerization: 500), 40 parts based on to solid content of carboxy modified SBR latex and 47 parts of starch particles (average particle diameter: 15 μm) were added to the capsule solution.

Then, water was added thereto to adjust the concentration based on the solid content to 20% to prepare a microcapsule solution.

The pigments, as shown in Table 1 below, were added to the microcapsule solution separately to prepare samples of Examples 1 through 3. The sample wherein no pigment was added to the microcapsule solution was identified as a sample of Comparative Example 1.

EXAMPLES 4 TO 6 AND COMPARATIVE EXAMPLE 2

The same procedure as in Examples 1 to 3 was repeated to prepare a microcapsule solution, except that 3.6 g of [2-anilino-6-(N-ethyl-N-isopentylamino)-3-methyl]xanthene-9-spiro-1'-(3'-isobenzofuran) and 1.0 g of 3-diethylamino-7-dibenzylamino fluoran as a color former were dissolved in 100 g of KMC-113.

The pigments as shown in Table 1 were added to the microcapsule solution to prepare samples of Examples 4 to 7. The sample wherein no pigment was added to the microcapsule solution was identified as Comparative Example 2 and the sample wherein a pigment having a pH of 8.5 or less was added was identified as Comparative Example 3.

These microcapsule solution were coated on a base paper having a basis weight of 40 g/m$^2$ using an air knife coating device, so that the dry coating amount was 4.0 g/m$^2$. The coated paper was dried to obtain microcapsule sheet.

The pressure-sensitive recording sheets combining the thus prepared microcapsule sheets and the developer sheet were evaluated and the results are shown in Table 1. The evaluation was done in the following manner.

(1) Fog at printing

Relief printing was done on the surface of the microcapsule layer of the microcapsule sheets for duplicating prepared in Examples and Comparative Examples. The microcapsule sheets were piled on the developer sheet in such a manner that the printed surface thereof faced the developer layer of the developer sheet and was allowed to stand under the conditions of 25° C. and 65 RH % with a load of 50 g/cm$^2$ for 1 week. After one week, the developer sheet was removed and fog formation was observed.

Fog formation at printing was evaluated based on the following rating system:

A: No fog was observed.
B: A slight degree of fog was observed.
C: Significant degree of fog was observed.
D: Heavy fog formation took place.

(2) Stain resistance

Two microcapsule sheets were piled and chafed against each with a load of 300 g/cm$^2$ and after one day, color stain on the capsule layer of the sheets was observed.

The degree of stain was evaluated based on the following rating system.

A: No stain was observed.
B: A slight degree of stain was observed.
C: Significant degree of stain was observed.

TABLE 1

| Sample No. | Pigments: Names of Chemical Agents | Compositions | pH* | Additive Amount (g/cm$^2$) | Fog at Printing | Resistance |
|---|---|---|---|---|---|---|
| Comparative Example 1 | — | — | — | — | D | C |
| Example 1 | TOMITA MgO DIA (Tomita Pharmaceutical Co., Ltd.) | MgO | 10.5 | 0.15 | B | A |
| Example 2 | Tancal (calcium carbonate) PC (Shiraishi Industries Co., Ltd.) | $CaCO_3$ | 9.5 | 0.2 | A | A |
| Example 3 | Hygilito H-43M (Showa Keikinzoku Co., Ltd.) | $Al(OH)_3$ | 9.2 | 0.25 | A | B |
| Comparative Example 2 | — | — | — | — | D | C |
| Example 4 | Unibur 70 (Shiraishi Industries Co., Ltd.) | $CaCO_3$ | 9.8 | 0.2 | A | A |
| Example 5 | Mizukasil P-83-2 (Mizusawa Kagaku Co., Ltd.) | Calcium coating silicic acid | 8.5 | 0.3 | A | B |
| Example 6 | Kyowa Suimag (Kyowa Kagaku Kogyo Co., Ltd.) | $Mg(OH)_2$ | 10.2 | 0.3 | A | A |
| Comparative Example 3 | Brilliant-15 (Shiraishi Kogyo Co., Ltd.) | $CaCO_3$ | 8.2 | 0.25 | C | B–C |

Remarks:
*The pH of a 10 wt % aqueous dispersion of pigment was measured using a pH meter.

It is understood from Table 1 that neither fog formation at printing nor color stain on the microcapsule sheet (upper paper) were observed in the microcapsule sheet for pressure-sensitive recording of the present invention. The present invention is particularly effective when pigments have a pH≧8.5.

In conclusion, a pressure-sensitive recording sheet which is free from fog formation at printing and from color stain on the upper paper, that is, a high quality sheet can be obtained by the use of basic pigments in a microcapsule containing layer.

While the invention has been described in detail and with reference to specific embodiments thereof, it will be apparent to one skilled in the art that various changes and modifications can be made therein without departing from the spirit and scope thereof.

What is claimed is:

1. A pressure-sensitive recording sheet which forms a colored image by the reaction of an electron donating color former with an electron accepting developer, comprising a support having provided thereon a microencapsulated electron donating color former and an electron accepting developer, wherein one or more layers containing the microencapsulated electron donating color former contains at least one pigment having a pH of 8.5 or more measured as a 10% aqueous pigment dispersion.

2. The pressure-sensitive recording sheet of claim 1, wherein the pigment having a pH of 8.5 or more is selected from the group consisting of calcium oxide, calcium hydroxide, calcium carbonate, calcium metasilicate, magnesium calcium carbonate, magnesium hydroxide, magnesium carbonate, magnesium oxide, aluminum hydroxide, aluminum silicate and calcium coated silicic acid.

3. The pressure-sensitive recording sheet of claim 2, wherein the pigment having a pH of 8.5 or more is present in the pressure-sensitive recording sheet in an amount of from 0.01 to 1.0 g/m$^2$.

4. The pressure-sensitive recording sheet of claim 2, wherein the pigment having a pH of 8.5 or more is present in the pressure-sensitive recording sheet in an amount of from 0.05 to 0.5 g/m$^2$.

5. The pressure-sensitive recording sheet of claim 1, wherein the pigment having a pH of 8.5 or more is present in the pressure-sensitive recording sheet in an amount of from 0.01 to 1.0 g/m$^2$.

6. The pressure-sensitive recording sheet of claim 1, wherein the pigment having a pH of 8.5 or more is present in the pressure-sensitive recording sheet in an amount of from 0.05 to 0.5 g/m$^2$.

7. The pressure-sensitive recording sheet of claim 1, wherein the microcapsule layer further contains a carboxy modified styrene-butadiene latex.

8. The pressure-sensitive recording sheet of claim 1, wherein the color formers are selected from the group consisting of triaryl methane type compounds, xanthene type compounds, thiazine type compounds, spiro type compounds, and a mixture of two or more of these compounds.

9. The pressure-sensitive recording sheet of claim 1, wherein the developer is selected from the group consisting of acid clay, active clay, attapulgite, zeolite, bentonite, kaolin, metal salts of aromatic carboxylic acids and phenol resins.

* * * * *